US008967064B2

(12) United States Patent
Myny

(10) Patent No.: US 8,967,064 B2
(45) Date of Patent: Mar. 3, 2015

(54) WATERCRAFT

(75) Inventor: Pieter Myny, Blanden (BE)

(73) Assignee: Karibu Invest, Leuven (BE)

( * ) Notice: Subject to any disclaimer, the term of this patent is extended or adjusted under 35 U.S.C. 154(b) by 0 days.

(21) Appl. No.: 13/806,446

(22) PCT Filed: Jun. 9, 2011

(86) PCT No.: PCT/BE2011/000036

§ 371 (c)(1),
(2), (4) Date: Dec. 21, 2012

(87) PCT Pub. No.: WO2011/160194

PCT Pub. Date: Dec. 29, 2011

(65) Prior Publication Data

US 2013/0102208 A1 Apr. 25, 2013

(30) Foreign Application Priority Data

Jun. 23, 2010 (BE) ..... 2010/0372

(51) Int. Cl.

| | |
|---|---|
| ***B63H 25/48*** | (2006.01) |
| ***B63B 1/10*** | (2006.01) |
| ***B63B 1/12*** | (2006.01) |
| ***B63B 29/04*** | (2006.01) |
| ***B63B 35/73*** | (2006.01) |
| ***B63H 25/00*** | (2006.01) |
| ***B63H 25/46*** | (2006.01) |
| ***B63H 25/52*** | (2006.01) |
| ***B63H 11/02*** | (2006.01) |

(52) U.S. Cl.

CPC *B63H 25/48* (2013.01); *B63B 1/10* (2013.01); *B63B 1/125* (2013.01); *B63B 29/04* (2013.01); *B63B 35/73* (2013.01); *B63H 25/00* (2013.01); *B63H 25/46* (2013.01); *B63H 25/52* (2013.01); *B63H 11/02* (2013.01)

USPC ..... 114/61.24; 440/38; 114/61.1

(58) Field of Classification Search

USPC ..... 114/61.1, 61.15, 61.19, 61.24; 441/129, 441/130; 440/21–32

See application file for complete search history.

(56) References Cited

U.S. PATENT DOCUMENTS 2,292,609 A * 8/1942 Buehler ..... 416/81
2,341,159 A * 2/1944 Neklutin ..... 114/274

(Continued)

FOREIGN PATENT DOCUMENTS

FR 2590861 A1 * 6/1987 ..... B63B 1/14
WO 99/50133 A1 10/1999

OTHER PUBLICATIONS

International Search Report, PCT/BE2011/000036, Nov. 30, 2011.

*Primary Examiner* — Edwin Swinehart
(74) *Attorney, Agent, or Firm* — Sughrue Mion, PLLC

(57) ABSTRACT

A watercraft, including; a mid section (2) and two side sections (3,4), whereby the mid section (2) has a seat (5) for a passenger and whereby the watercraft (1) has a steering mechanism. The watercraft (1) includes a front part (2) and a rear part, relative to a direction of travel of the watercraft (7), that are coupled together by means of a hinged coupling (8). The front part (2) of the watercraft (1) includes the mid section (2) of the watercraft (1), and the rear part (7) of the watercraft (1) includes the two side sections (3,4). The hinged coupling (8) forms part of the steering mechanism, such that as a result of a rotation of the front part (2) with respect to the rear part (7) of the watercraft (1) around the hinged coupling (8), the direction of travel of the watercraft (1) is changed.

14 Claims, 3 Drawing Sheets

(56) References Cited

U.S. PATENT DOCUMENTS

| | | | | | |
|---|---|---|---|---|---|
| 2,991,746 | A | * | 7/1961 | Cunningham | 114/283 |
| 3,786,774 | A | | 1/1974 | Gabel | |
| 3,799,565 | A | * | 3/1974 | Burtis et al. | 280/16 |
| 4,315,475 | A | | 2/1982 | Echols | |
| 4,968,274 | A | * | 11/1990 | Gregory | 440/27 |
| 5,443,028 | A | | 8/1995 | Keen | |
| 5,590,616 | A | * | 1/1997 | Vera | 114/61.16 |
| 5,626,501 | A | | 5/1997 | He | |
| 5,692,450 | A | | 12/1997 | Alter et al. | |

* cited by examiner

WATERCRAFT

FIELD OF THE INVENTION

Background of the Invention

More specifically the invention relates to a watercraft intended for recreational use that consists of a mid section and two side sections, with which sections the watercraft can float on water, whereby the mid section has a seat for a passenger and whereby the watercraft has a steering mechanism.

Such watercrafts are already known, for example in the form of a speed boat, yacht or similar, that generally have a limited draught and to this end, for reasons relating to the stability of the boat in water, are constructed with a mid section and two side sections with which the boat rests on the water.

A disadvantage of the known watercrafts of this type is that they are relatively poorly maneuverable and that the radius of the turning circle when making a turn with such a watercraft is rather large.

Another disadvantage of the known watercrafts of the aforementioned type is that they often have a very unwieldy construction.

A further disadvantage of the known watercrafts of the aforementioned type is that they present a relatively high resistance when sailing, especially at high speeds.

More specifically the profile of known watercrafts of the aforementioned type is such that when sailing at high speeds, the watercraft has the tendency to move up and down on the water with its bow, or to crash into the water surface in a continually repeating movement, whereby every downward movement is coupled with a high resistance.

Sailing at high speeds with such known watercrafts thus requires an enormous amount of energy and/or powerful engines, with high costs as a result.

The purpose of the present invention is to provide a solution to the aforementioned disadvantages and other disadvantages.

The purpose of the invention is to obtain a watercraft that can sail at high speeds without problems, similar to the speeds achieved by speedboats or jet skis, whereby it is also the intention to reduce the energy consumption.

Moreover, the purpose of the invention is to obtain a watercraft with extremely high maneuverability, but with a very simple steering mechanism.

SUMMARY OF THE INVENTION

To this end the present invention relates to a watercraft intended for recreational use that consists of a mid section and two side sections, with which sections the watercraft can float on the water, whereby the mid section has a seat for a passenger and the watercraft has a steering mechanism, whereby moreover the watercraft consists of a front part and a rear part that are coupled together by means of a hinged coupling, whereby the front part of the watercraft is primarily formed by the aforementioned mid section of the watercraft, and the aforementioned two side sections form part of the rear part of the watercraft, and whereby the hinged coupling forms part of the steering mechanism, such that as a result of the rotation of the front part with respect to the rear part of the watercraft around the hinged coupling, the sailing direction of the watercraft is changed.

A big advantage of a watercraft according to the invention is that the watercraft is highly maneuverable as a result of the presence of the aforementioned hinged coupling.

Indeed, by rotating the front part of the watercraft with respect to the rear part of the watercraft through the hinged coupling, these two parts of the watercraft can be put in an oblique position with respect to one another, so that when turning the watercraft can follow a turning circle with a much smaller radius than the radius of the turning circles of the known rigid watercrafts that are manufactured as one part, and which do not have such a hinged coupling.

Moreover, the steering mechanism of a watercraft according to the invention is formed by the aforementioned hinged coupling, which can be steered in a very easy way.

Preferably the rear part of a watercraft according to the invention has handles to this end that a passenger seated on the seat in the mid section or front part of the watercraft can hold on to, in order to make the front part of the watercraft rotate with respect to the rear part of the watercraft by moving his body.

It is clear that such an embodiment of a watercraft according to the invention is very simple to control and also extremely maneuverable.

Another preferred characteristic of a watercraft according to the invention consists of equipping the front part with a foil profile at a certain distance under the bottom of the first part.

According to the invention, the foil profile is such that with a sufficiently fast forward movement of the watercraft, an upward force is exerted on the foil profile by the water so that the front part of the watercraft is at least partially, and preferably completely, pushed out of the water.

A watercraft according to the invention that has such a foil profile provides the advantage that the resistance that the watercraft experiences at high speeds is kept to a minimum, as the front part of the watercraft that takes the bulk of the weight of a passenger is barely in contact with the water, but only via the aforementioned foil profile.

As a result, higher speeds can be reached with a watercraft according to the invention than with the known watercrafts of the same type, at least insofar both watercrafts are driven with the same force.

On the other hand, to obtain the same relatively high speed, less energy or force is required in a watercraft according to the invention than with known watercrafts of the same type.

BRIEF DESCRIPTION OF THE DRAWINGS

With the intention of better showing the characteristics of the invention, a preferred embodiment of a watercraft according to the invention is described hereinafter by way of an example without any limiting nature, with reference to the accompanying drawings, wherein.

DETAILED DESCRIPTION OF THE INVENTION

Figure 1:
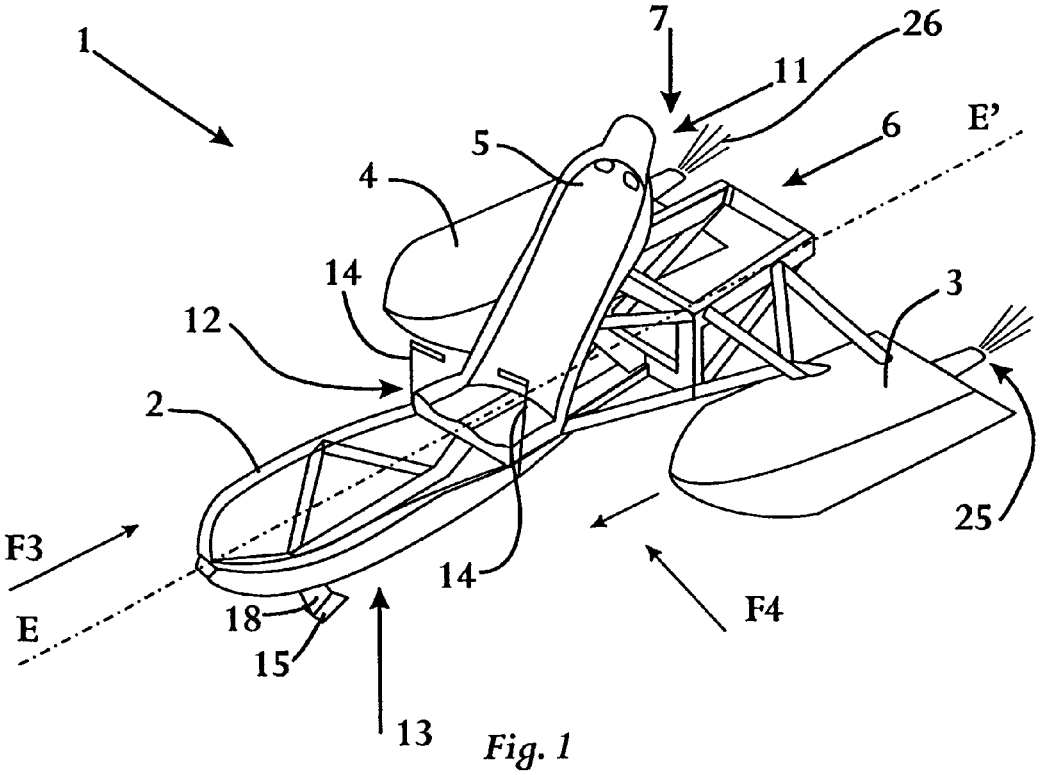
FIGS. 1 and 2 schematically show a simplified perspective of a possible embodiment of a watercraft according to the invention, respectively from a viewpoint in front of the watercraft and behind the watercraft.
Figure 2:
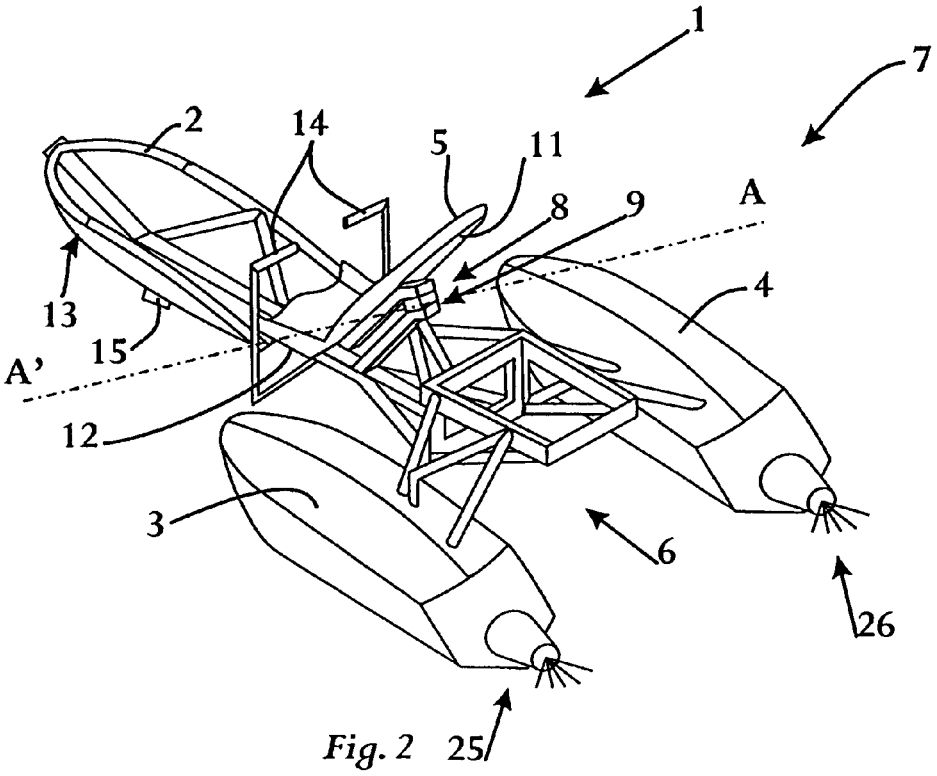
Figure 3:
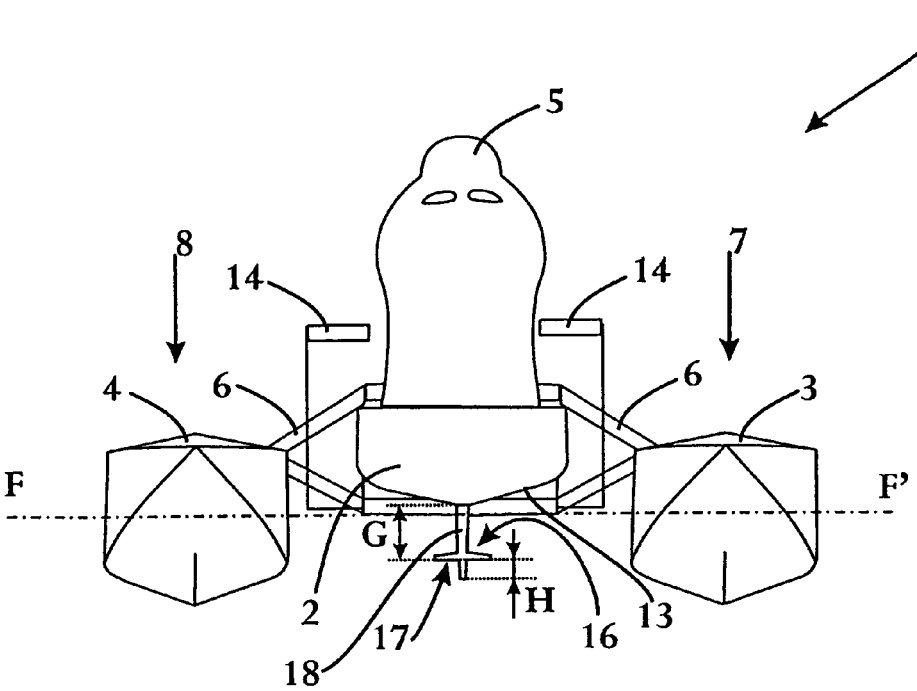
FIG. 3 shows a front view of the watercraft of FIGS. 1 and 2 according to a direction indicated by the arrow F3 in FIG. 1.
Figure 4:
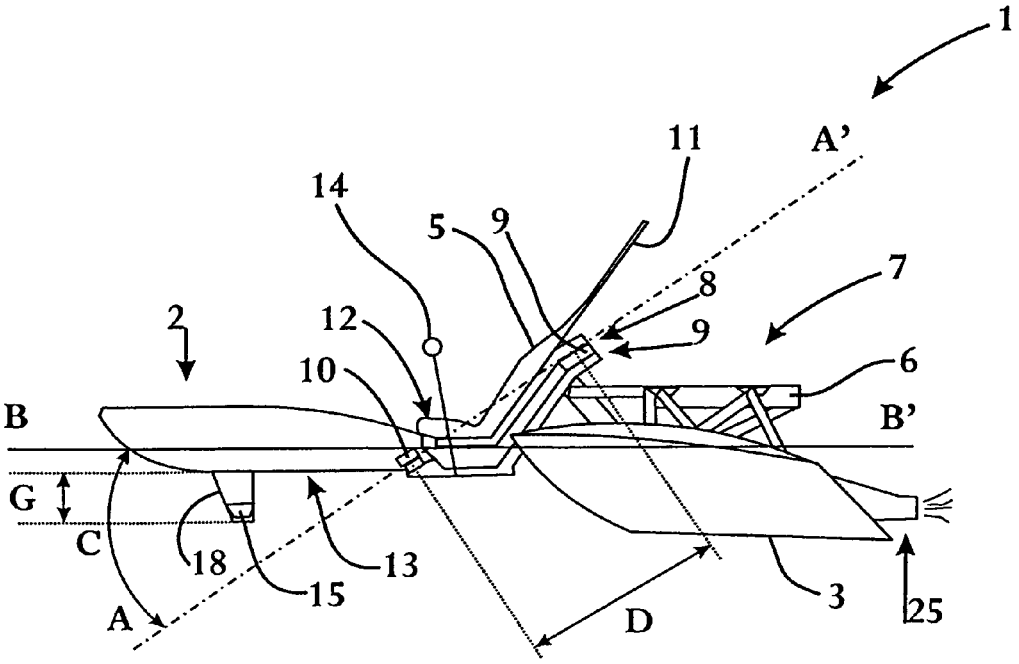
FIG. 4 shows a side view of the watercraft of FIGS. 1 and 2 according to a direction indicated by the arrow F4 in FIG. 1.
Figure 5:
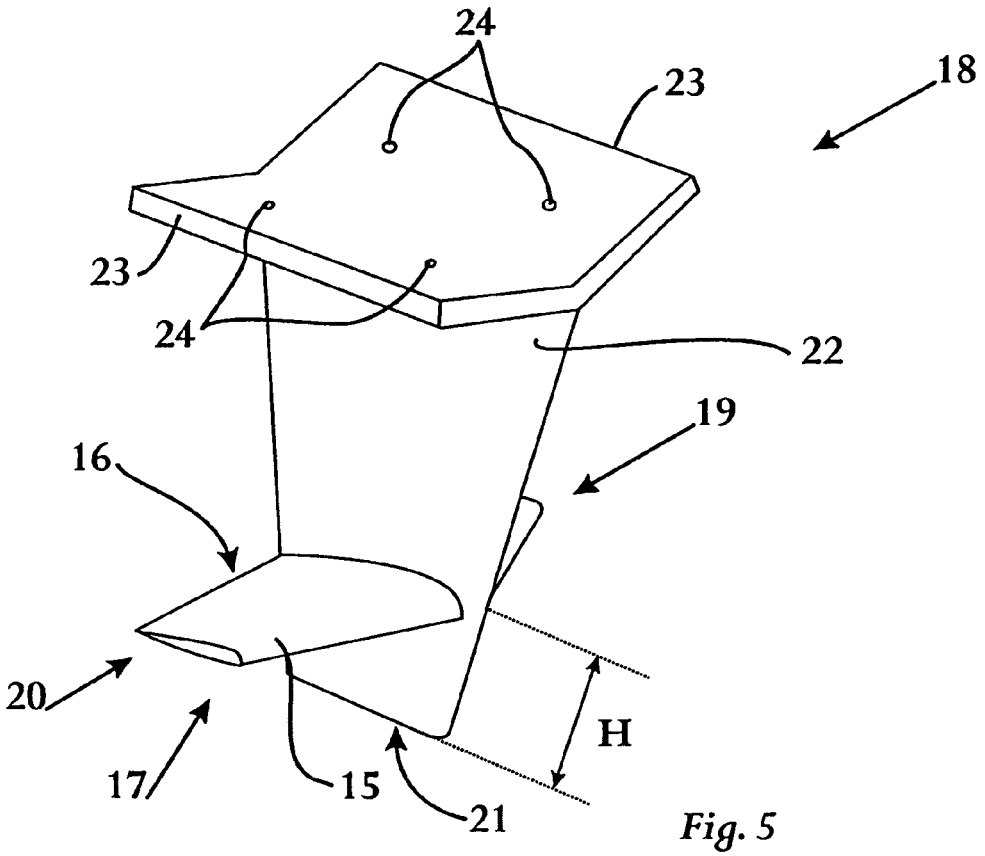
FIGS. 5 and 6 show a possible embodiment in perspective of a foil profile that is on the mid section of a watercraft according to the invention, respectively from a viewpoint in front of and behind the foil profile, indicated by the arrows F5 and F6 in FIGS. 3 and 4.

The watercraft 1 according to the invention shown in FIGS. 1 to 4 is a watercraft intended for recreational use, for example for making pleasure trips or practising water sports or similar.

These FIGS. 1 to 4 are only simple illustrations of a possible embodiment of a watercraft 1 according to the invention, whereby the characteristics of the watercraft 1 that are important for the invention are made clear, but other parts of the watercraft 1 are not shown, such as a drive means or other structural elements that can form the actual superstructure of the watercraft 1, such as for example a deck, a load platform, a railing or similar.

The watercraft 1 consists of a mid section 2 and two side sections 3 and 4.

The mid section 2 is constructed as a kind of tub, while the side sections 3 and 4 are floating floats formed by hollow closed chambers that are filled with air or a light material such as a foam rubber or similar.

Of course it is the intention that these sections 2 to 4 ensure that the watercraft 1 can float on the water.

The mid section 2 has a seat 5 for a passenger (not shown in the drawings), whereby the tub of the mid section 2 acts as a support for the legs and feet of such a passenger.

In the example shown, the side sections 3 and 4 are connected together into a rigid unit by means of a frame 6, but other embodiments are not excluded, such as embodiments in which the sections 3 and 4 are constructed as a monolithic whole and similar.

A first important characteristic of a watercraft 1 according to the invention is that the watercraft 1 consists of a front part 2 and a rear part 7 that are connected together by means of a hinged coupling 8.

As a result the front part 2 of the watercraft 1 is primarily formed by the aforementioned mid section 2 of the watercraft 1.

Moreover, the aforementioned two side sections 3 and 4 form part of the rear part 7 of the watercraft 1, as well as the frame 6 and any other components that are not shown in the drawings.

In this case, the hinged coupling 8 is formed by two hinges, respectively a first hinge 9 and a second hinge 10 that are placed at a certain distance D from each other between the front part 2 and the rear part 7 of the watercraft 1.

More specifically, the first hinge 9 is mounted on the back of a backrest 11 of the seat 5, while the second hinge 10 is affixed below a seating surface 12 of the seat 5.

These hinges 9 and 10 work together and to this end are aligned along an axis AA', such that the front or mid section 2 can undergo a rotation around this axis AA' with respect to the rear part 7 of the watercraft 1.

According to the invention, this axis AA' is preferably in an oblique position with respect to the bottom 13 of the front part 2 of the watercraft 1, or in other words an oblique position with respect to the waterline BB' when the watercraft 1 is floating at rest on the water.

In the example shown, the bottom 13 of the mid section 2 of the watercraft 1 in such a rest position is practically parallel to the waterline BB'.

As a result, the angle C between the axis AA' and the waterline BB' or the bottom 13 is around 35.degree., but other angles C are not excluded according to the invention.

Of course it is the intention that the hinged coupling 8 forms part of the steering mechanism of the watercraft 1, such that by rotating the front part 2 with respect to the rear part 7 of the watercraft 1 around the hinged coupling 8, the sailing direction of the watercraft 1 is changed.

According to a preferred embodiment of a watercraft 1 according to the invention, the rear part 7 of the watercraft 1 has handles 14 that a passenger seated in the seat 5 can hold onto.

It is hereby the intention that the passenger can make the front part 2 of the watercraft 1 rotate with respect to the rear part 7 of the watercraft 1 by moving his body, such that the sailing direction of the watercraft 1 can be changed in this way.

With the handles 14, the passenger can exert the necessary torque to realise the rotation.

Preferably, according to the invention it is also ensured that the side sections 3 and 4 of the rear part 7 extend no further in the sailing direction than a plane that extends through the axis AA' of the hinges 9 and 10 and which is oriented transverse to the axial direction EE' of the watercraft 1.

In this way a rotation of the front part 2 with respect to the rear part 7 of the watercraft 1 is not impeded in any way, such that a highly maneuverable watercraft 1 is obtained.

Although not strictly necessary for the invention, the side sections 3 and 4 are preferably constructed as floating floats that can be detached from the watercraft 1.

This enables the watercraft 1 to be configured as desired by changing the form or type of the side sections 3 and 4, for example in order to adapt the watercraft 1 for carrying larger or smaller loads.

According to a preferred embodiment of a watercraft 1 according to the invention, the side sections 3 and 4 consist of floating floats that are adjustable with respect to the watercraft 1.

By making these side sections adjustable in the breadthwise direction FF' of the watercraft 1, it is possible to influence the stability of the watercraft 1.

More specifically, the 'rolling motion', which is the rocking, back and forth rotating movement of the watercraft 1 around the axial direction EE' of the watercraft 1, can be limited by moving the side sections 3 and 4 further apart in the breadthwise direction FF'.

Making the side sections 3 and 4 adjustable in the longitudinal direction EE' of the watercraft can also make sense, as in this way the distance between the front part 2 and the rear part 7 can be adapted, for example to obtain a better weight distribution or similar.

Another preferred characteristic of a watercraft according to the invention consists of the front part 2 of the watercraft 1 having a foil profile 15 at a certain distance G below the bottom 13 of the mid section 2.

The foil profile 15 is of course preferably such that with a sufficiently fast forward movement of the watercraft 1, an upward force is exerted on the foil profile 15 by the water, such that the front part 2 of the watercraft 1 is at least partially, and preferably completely, pushed out of the water.

To this end, as is known, the top 16 of the foil profile 15 is constructed with a larger curve than the underside 17 of the foil profile, in order to produce the necessary lift.

According to a preferred embodiment of a watercraft according to the invention, the foil profile 15 is affixed to a leeboard 18.

Figure 6:
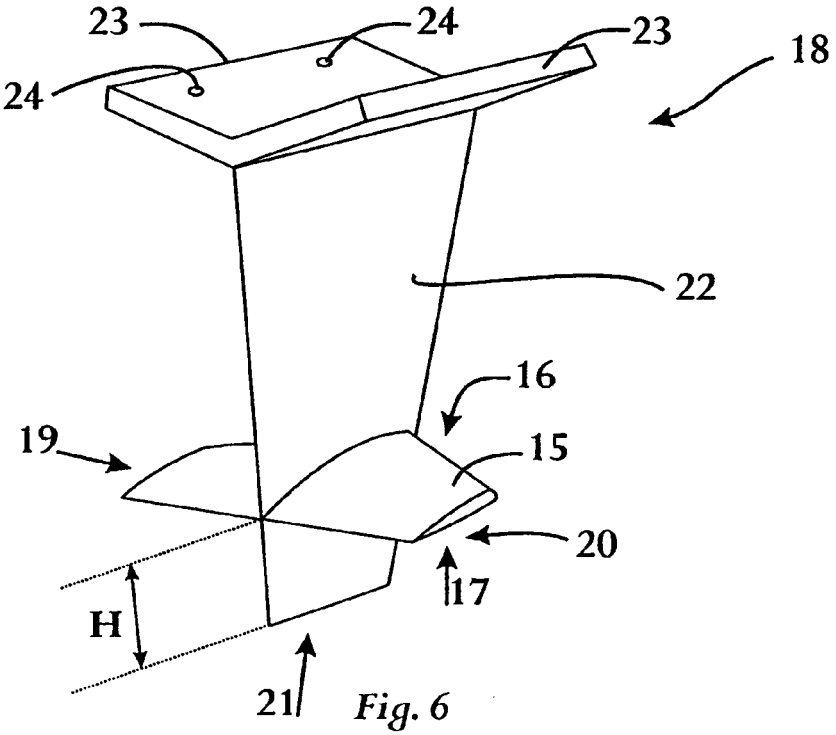

As shown in more detail in FIGS. 6 and 7, the foil profile 15 contains two foils 19 and 20 that extend on either side of the leeboard 18.

Moreover, in the example shown in FIGS. 6 and 7 the foils 19 and 20 are affixed at a distance H from the free end 21 of the leeboard 18.

The foil profile 15 shown in FIGS. 6 and 7 is moreover detachable.

For this purpose the leeboard 18 has a V-shaped profile 23 at the other end 22, whose V-shape can accurately fit to the keel of the front part 2.

In this case the leeboard 18 has holes 24 in the V-shaped profile 23 for bolting the leeboard 18 to the front part 2, but other means for fastening the leeboard 18 to the front part 2 of the watercraft 1 are of course not excluded.

In this way it is possible, for example, to exchange the leeboard 18, and thus the foil profile 15 on this leeboard 18, for a leeboard 18 with a different type of foil profile 15 or with a different length, or such.

According to another preferred embodiment of a watercraft according to the invention, the rear part 7 of the watercraft 1 has a motorised drive.

Preferably this motorised drive is formed by at least one jet ski engine, and preferably the motorised drive is formed by two engines 25 and 26, where each of the engines 25 and 26 are affixed on either side section 3 and 4 of the watercraft 1.

Such an embodiment of a watercraft 1 according to the invention provides the advantage that with appropriate control of the engines 25 and 26, the sailing direction of the watercraft 1 can also be influenced, whereby the steering of the watercraft by a passenger can be done without requiring too much muscle power from the passenger.

The present invention is by no means limited to the embodiment of a watercraft according to the invention described as an example and illustrated in the drawings, but a watercraft according to the invention can be realised in all kinds of variants, without departing from the scope of the invention.

The invention claimed is:

1. A watercraft, comprising:

a front part (2) and a rear part (7), relative to a direction of travel of the watercraft (1);

wherein the front part (2) includes a mid section (2);

wherein the rear part (7) includes two side sections (3,4), whereby the watercraft (1) can float on the water with the mid section (2) and the two side sections (3,4), whereby the mid section (2) has a seat (5) for a passenger and whereby the watercraft (1) has a steering mechanism, wherein the front part (2) and the rear part (7) are coupled together by means of a hinged coupling (8), and whereby the hinged coupling (8) forms part of the steering mechanism, such that as a result of a rotation of the front part (2) with respect to the rear part (7) of the watercraft (1) around the hinged coupling (8), the direction of travel of the watercraft (1) is changed; and wherein the seat (5) has a backrest (11) and a seating surface (12), whereby the hinged coupling (8) includes two hinges (9,10) and whereby a first hinge (9) is affixed to the backrest (11) of the seat (5) and the second hinge (10) is affixed below the seating surface (12) of the seat (5).

2. Watercraft (1) according to claim 1, wherein the hinges (9, 10) are configured to enable a rotation of the front part (2) and the rear part (7) of the watercraft (1) with respect to one another around an axis (AA') that is oblique with respect to the bottom (13) of the front part (2) of the watercraft (1).

3. Watercraft (1) according to claim 2, wherein the side sections (3,4) extend no further in the direction of travel than a plane that extends through the axis (AA') and transversely to the axial direction (EE') of the watercraft (1).

4. Watercraft (1) according to any one of the foregoing claims, wherein the front part (2) is constructed as a tub that acts as a support for the legs and feet of a passenger.

5. Watercraft (1) according to claim 1, wherein the rear part (7) of the watercraft (1) has handles that a passenger seated on the seat (5) can hold on to, in order to make the front part (2) of the watercraft (1) rotate with respect to the rear part (7) of the watercraft (1) by moving his body.

6. Watercraft (1) according to claim 1, wherein the side sections (3,4) include floating floats that are detachable from the watercraft (1).

7. Watercraft (1) according to claim 1, wherein the side sections (3,4) include floating floats that are adjustable with respect to the watercraft (1).

8. Watercraft (1) according to claim 1, wherein the front part (2) has a foil profile (15) at a certain distance (G) below the bottom (13) of the mid section (2).

9. Watercraft (1) according to claim 8, wherein the foil profile (15) is such that with a sufficiently fast forward movement of the watercraft (1) an upward force is exerted on the foil profile (15) by the water, such that the front part (2) of the watercraft (1) is at least partially pushed out of the water.

10. Watercraft (1) according to claim 8 or 9, wherein the foil profile (15) is affixed to a leeboard (18), whereby the foil profile (15) contains two foils (19,20) that extend to either side of the leeboard (18) and whereby the foils (19,20) are affixed at a distance (H) from the free end (21) of the leeboard (18).

11. Watercraft (1) according to claim 8 or 9, wherein the foil profile (15) is detachable.

12. Watercraft (1) according to claim 1, wherein the rear part (7) of the watercraft (1) has a motorised drive (25,26).

13. Watercraft (1) according to claim 12, wherein the motorised drive is formed by at least one engine (25,26).

14. Watercraft (1) according to claim 12 or 13, wherein the motorised drive is formed by two engines (25,26), where each of the two engines (25,26) are affixed on each side section (3,4) of the watercraft (1).

* * * * *